US006321177B1

(12) United States Patent
Ferrero et al.

(10) Patent No.: US 6,321,177 B1
(45) Date of Patent: Nov. 20, 2001

(54) PROGRAMMABLE DIVE COMPUTER

(75) Inventors: Jaime Ferrero, Wilmette; William A. Bowden, Glenview; Joseph B. Stella, Northfield, all of IL (US); Joran Ahlback, Masala (FI); Kai M. Martesuo; Esa T. Raivio, both of Helsinki (FI)

(73) Assignee: Dacor Corporation, Norwalk, CT (US)

( * ) Notice: Subject to any disclaimer, the term of this patent is extended or adjusted under 35 U.S.C. 154(b) by 0 days.

(21) Appl. No.: 09/229,107

(22) Filed: Jan. 12, 1999

(51) Int. Cl.[7] ..... G06F 702/166

(52) U.S. Cl. ..... 702/166; 702/166; 702/176; 702/177; 702/178; 324/115; 73/714

(58) Field of Search ..... 702/166, 176, 702/177, 178

(56) References Cited

U.S. PATENT DOCUMENTS 3,864,977 * 2/1975 Leemann ..... 73/714
4,124,840 * 11/1978 Kobayashi ..... 340/501
5,482,405 * 1/1996 Tolksdorf et al. ..... 405/168
5,656,935 * 8/1997 Havel ..... 324/115
5,663,897 * 9/1997 Geiser ..... 702/182
5,737,246 * 4/1998 Furukawa et al. ..... 702/166

* cited by examiner

*Primary Examiner*—Arthur T. Grimley
*Assistant Examiner*—Mohamed Charioui
(74) *Attorney, Agent, or Firm*—Greer, Burns & Crain, Ltd.

(57) ABSTRACT

An interactive dive apparatus for use by a scuba diver to determine a maximum dive duration, including an input interface for inputting dive specific parameters including a J-factor for adjusting a no-stop time calculation to compensate for various environmental and physiological parameters, a clock for determining an elapsed dive time, and a depth sensor for detecting a present depth and a maximum depth. The depth sensor tracks diver dwell time in each of plural predetermined depth ranges, and a CPU determines a no-stop time in accordance with the user inputted dive specific parameters and the detected dwell time. The interactive dive apparatus further includes a display screen for displaying at least the no-stop time, elapsed dive time duration and the current depth.

11 Claims, 2 Drawing Sheets

PROGRAMMABLE DIVE COMPUTER

FIELD OF THE INVENTION

The present invention relates to computer systems for monitoring and displaying the status of various underwater diving related parameters, such as current and maximum dive depth, elapsed diving time (bottom time), remaining no-decompression dive time (no stop time), depth/time limits, rate of ascent/descent and the like. The invention further relates to a computer system which enables a scuba diver to tailor the no decompression dive time calculation to compensate for the physiological condition of the diver, prevailing environmental factors and the like.

BACKGROUND OF THE INVENTION

A continuing concern of users of scuba gear relates to the desire to maximize diving time while maintaining an adequate safety margin. The human body includes numerous distinct tissue groups which absorb and retain gases at varying rates in relation to numerous factors including but not limited to atmospheric pressures. Thus, for example, each tissue group will reach a predetermined saturation threshold at varying rates depending on the prevailing atmospheric pressure and dive depth. The factors affecting the rate of absorption as well as the rate in which gases are expelled (off-gassed) from the tissues are collectively known within the scuba diving field as J-factors.

Empirical studies have shown that a diver can safely return to the surface without the need for decompression stops so long as none of the tissue groups are saturated. Correspondingly, once the diver has exceeded the saturation threshold, additional precautions, i.e., decompression stops, will be necessary to ensure sufficient time for the saturated tissue to expel excess gases.

Conventional dive planners and computers simplify the calculation of the time a diver can spend at a given depth without the need to factor in decompression stops (no-stop time). However, these planners and computers present a one-size-fits-all approach which fails to account for variations in environmental conditions as well as the individual physiological condition of the diver. Importantly, these factors impact the rate of gas absorption of the aforementioned tissue groups.

For example, the tissue of a diver who has engaged in multiple dives in a short span of time will reach saturation faster than it would for that diver's first dive. Likewise, the tissue of an older diver or a less physically fit diver will reach saturation faster than a younger or more physically fit diver.

By necessity, the calculations embodied in conventional planners and computers incorporate a significant (fixed) safety factor to ensure the safety of the user despite the fact that they arc unable to compensate for the above-described variations in the rate of gas absorption.

The magnitude of the above-described safety factor unnecessarily curtails the dive time to ensure that none of the tissue groups become saturated, i.e., to avoid the need for decompression stops. The use of an unnecessarily large safety factor wastes the diver's time and resources and restricts diving flexibility.

Consequently, there is a need for a diving computer which enables the user to tailor the no-stop time calculations to reflect existing environmental conditions as well as factors pertaining to the diver's physiological condition, i.e., account for the J-factors.

Another concern for users of scuba equipment relates to the need to display various dive related information in a convenient manner. Due to various safety concerns, divers must periodically refer to the dive computer to monitor their current depth, dive time duration, and remaining no-stop time.

Conventional dive computers are inflexible in that they do not provide the diver with the ability to select the type of information displayed. Notably, conventional dive computers fall into two categories—minimalist displays which display only the bare minimum information which every diver must track, and maximalist displays which display a plethora of dive-related information.

Minimalist displays are ideal for novice divers in that they force the diver to focus on the important information. However, these minimalist displays do not provide sufficient information for intermediate and advanced divers who wish to track additional dive related parameters. Moreover, existing maximalist displays are unsatisfactory even to advanced divers because they present too much information at one time, and do not allow the diver to select the type of information displayed.

Therefore, there is a need for an improved diving computer including a customizable display feature allowing the user to select the type and amount of information shown on a display.

Yet another concern for users of scuba equipment relates to the need to warn the user with respect to various alter conditions such as, for example, too rapid an ascent, the need for decompression stops, and low battery state. Conventional diving computers use light sources, such as LED's mounted in the casing, situated outside the display, for warning purposes. Alternatively, some diving computers utilize audible beeps to alert the diver that something is wrong. None of these methods is ideal.

During an emergency situation, the diver has a very limited ability to comprehend information. Moreover, the diver's response time is hampered if the information is unclear or needs to be found in several locations. Importantly, reduced visibility conditions may make it difficult or impossible for the diver to see a flashing LED light. Also, thick hoods such as used in dry suits impair the divers ability to adequately hear audible beeps clearly enough to ensure that a warning would be always noticed.

Consequently, there is a need for an improved method for alerting the diver to respond to an emergency situation.

The renting or sharing of diving equipment raises the need to clear the information stored in the diving computer. Previous approaches to resetting (clearing) stored data have included the use of mechanical switches that turn off the power to the unit making it "forget" the stored data. These mechanical switches such as HALL transducers or REED switches are prone to physical shock and corrosion.

Consequently, there is a need for an improved method for clearing stored data which does not rely on mechanical switches.

In response to these problems, one object of the present invention is to provide an improved dive computer which enables the user to tailor the no-stop time calculation to account for environmental and physiological parameters (J-factors).

Another object of the present invention is to provide an improved dive computer having user customizable display features allowing the user to display the type and amount of data displayed.

Another object of the present invention is to provide an improved dive computer whose display promptly alerts the user of an alert condition.

Yet another object of the present invention is to provide an improved method for clearing a dive computer of diver-specific parameters without the use of mechanical switches.

SUMMARY OF THE INVENTION

The above-identified objects are met or exceeded by an interactive apparatus for use by a scuba diver to determine a maximum no-decompression (no-stop) dive duration. The interactive apparatus (dive computer) includes an interface for adjusting the no-stop time calculation to account for environmental factors as well as aspects of the diver's physiology (J-factors). The dive computer further includes a hierarchical warning messaging system for warning the diver of various alert conditions. Moreover, the diver computer also provides an easy method for clearing the diver specific parameters from memory.

According to one aspect of the invention, the dive computer includes an input interface for inputting dive specific parameters including a J-factor for adjusting a no-stop time calculation to compensate for various environmental and physiological parameters, a clock for determining an elapsed dive time, and a depth sensor for detecting a present depth and a maximum depth, and tracking a dwell time in each of plural predetermined depth ranges.

A CPU communicating with the input interface, clock, and depth sensor determines a maximum no-decompression dive time (no-stop time) in accordance with the J-factor (described below) and the detected dwell time at each of plural predetermined depth ranges.

The interactive dive apparatus further includes a display screen for displaying at least the no-stop time, elapsed dive time duration and the current depth.

According to a further aspect of the invention, the interactive dive apparatus includes a hierarchical warning feature for alerting the scuba diver of an alert condition, such that if multiple alert conditions exist only a highest priority warning is displayed.

According to a further aspect of the invention, a background color of the display screen displays a first color designating a normal non-alert condition, a second color designating an intermediate alert condition, and flashes the second color to designate an advanced alert condition.

According to a further aspect of the invention, the CPU instructs the display screen to illuminate the second backlight color when the no-decompression dive time has expired, and instructs the display screen to display a decompression warning message in a warning field of the display.

According to another aspect of the invention, the interactive dive apparatus includes an ascent detection function for detecting a rate of ascent, and transmitting the detected rate of ascent to the CPU, wherein the CPU compares the detected rate of ascent with a predetermined maximum safe rate of ascent and instructs the display screen to display and flash the second backlight color when the detected rate of ascent exceeds the maximum safe rate of ascent. Moreover, the CPU instructs the display screen to display an ascent warning message in a warning field of the display. Notably, the ascent warning message has a higher priority than the decompression warning message.

According to another aspect of the invention, the interactive dive apparatus includes a battery monitor for alerting the CPU processor when a low battery condition exists, whereupon the CPU instructs the display screen to display the second backlight color and display a battery warning message in a warning field of the display screen. Notably, the battery warning message has a lower priority than the decompression warning message.

According to another aspect of the invention, the display screen of the interactive dive apparatus includes a predetermined number of customizable display fields in which the scuba diver selects information to be displayed.

According to yet another aspect of the invention, the interactive dive apparatus includes a software reset command for clearing stored data from memory including a safety mechanism which assuredly prevents clearing of the stored data once a dive has commenced.

DESCRIPTION OF THE PREFERRED EMBODIMENT

Figure 1:
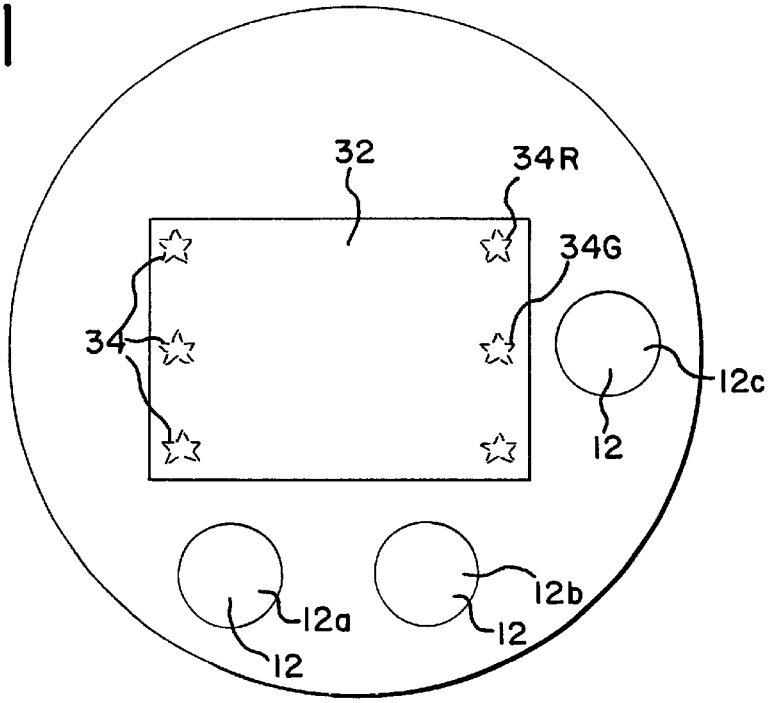
FIG. 1 is a top view of a dive computer of the type incorporating the present invention.

The interactive dive computer of the present invention will be described with reference to FIG. 1. The dive computer, generally designated 10 is intended for use by a scuba diver to determine a maximum dive duration which can be made without the need for decompression stops. In other words, a maximum no-stop time. The magnitude of the no- stop time is determined using a well-established calculation known as the Buhlmann algorithm. This algorithm is well known within the field of scuba diving, making a discussion of the algorithm and its input unnecessary.

As described in the background section above, one deficiency associated with conventional dive computers relates to their one-size-fits-all method of determining no-stop time. The present invention features the ability to provide the diver with a method for adapting the results of the Buhlmann algorithm to account for environmental aspects and the physiological condition of the diver. Specifically, the results of the Buhlmann algorithm are adapted using a J-factor which affects depth information input into the Buhlmann algorithm. Importantly, each incremental value of the J-factor results in a 20 centimeter adjustment to the depth information input into the Buhlmann algorithm.

According to one aspect of the present invention, the diver selects an appropriate J-factor value which reflects the prevailing environmental aspects and the physiological condition of the diver. Table I below lists factors which are summed to determine the J-factor value. According to the preferred embodiment, the J-factor is ranges from 0 to +9(for safety reasons, the algorithm can only be made more conservative); however, one of ordinary skill in the art will appreciate that additional or different factors may be used. Notably, each of the J-factors listed in Table I are accorded equal weight.

However, it is contemplated that J-factors may be accorded different weights.

TABLE 1

| | |
|---|---|
| Environmental Related Factors | |
| Water Temperature: | (Cold −) or (Warm +) |
| Diving Environment: | (Harsh −) or (Easy +) |
| Diver Related Factors | |
| Age: | (Old −) or (Young +) |
| Gender: | (Female −) or (Male +) |
| Health: | (Fair −) or (Good +) |
| Stamina: | (Tired −) or (Well rested +) |
| Fluid intake: | (Dehydrated −) or (Well hydrated +) |
| Protection: | (Wet suit −) or (Dry suit +) |
| Diving Related Factors | |
| Dives: | (Repetitive Dive −) or (Single Dive +) |

The dive computer 10 includes an input interface 12 which, in the preferred embodiment consists of three wet contacts 12*a*, 12*b*, and 12*c*. The input interface 12 enables the diver to enter dive specific parameters by scrolling through a command tree.

Contact 12*b* is connected to a ground terminal, and terminals 12*a* and 12*c* are connected to a CPU 26 (FIG. 2) through 390 k ohm series resistors (not shown), and are additionally connected to a positive side of a voltage source (not shown) via 1M ohm resistors (not shown).

One input is activated by touching contact 12*a* and contact 12*b* (ground terminal) at the same time, allowing a sub-micro ampere current to flow through the user's fingers. Another input is activated by touching contact 12*c* and contact 12*b* (ground terminal) at the same time, allowing a sub-micro ampere current to flow through the user's fingers. Moreover, touching all three contacts 12*a*–12*c* will activate both inputs (which also is the case when the device is submerged in water). Thus, by defining a distinct sequence of combinations, and setting a timeout to each stage of the sequence one can prevent inadvertent triggering. This aspect is important because, as will be discussed below, the memory contents may be deleted using a predetermined sequence of inputs, and it obviously would be undesirable to inadvertently clear the memory when the unit is in use.

In operation, the diver scrolls through the command tree by simultaneously depressing contacts 12*a* and 12*b*, and scrolls through entry values for a given command by simultaneously depressing contacts 12*b* and 12*c*.

Thus, for example, to enter a J-factor into the dive computer, the user scrolls through the various branches in the command tree until the J-factor command is selected and then the user scrolls through and selects an appropriate J-factor.

Figure 2:
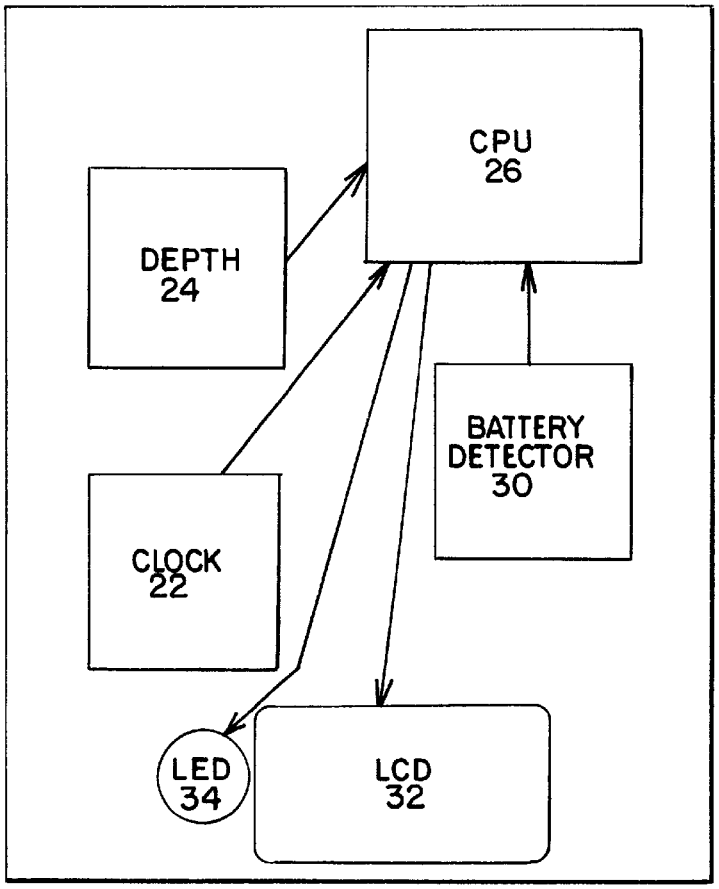
FIG. 2 is functional schematic diagram of the dive computer of FIG. 1.

A functional description of the dive computer of the present invention will now be described with referenced to FIG. 2. The dive computer 10 includes a conventional ascent detector 20 for detecting a rate of ascent, a clock 22 for measuring an elapsed dive time duration and a conventional depth sensor 24 for detecting a present depth and storing a maximum dive depth.

The depth sensor 24 cooperates with the clock 22 to accumulate an amount of time the diver has spent in each of plural depth ranges. According to a preferred embodiment, the depth sensor determines a depth value once a second; however, other intervals are contemplated.

The dive computer 10 includes a CPU 26 which uses the depth sensor values from the depth sensor 24 as an input for determining the Buhlmann algorithm. According to a preferred embodiment, the CPU 26 determines an average depth every six seconds, and uses the determined average depth in the Buhlmann algorithm however, other intervals are contemplated.

A display screen 32 is provided for displaying dive related information. According to the preferred embodiment, the display screen 32 is a conventional LCD screen. One of ordinary skill in the art will readily appreciate other display screens which may readily be substituted for an LCD screen.

According to one aspect of the present invention, the dive computer 10 incorporates a hierarchy of warning messages for alerting the scuba diver of an alert condition. The relative ranking of the warning messages determines which message will be displayed in the event that two or more alert conditions occur simultaneously.

Moreover, the dive computer of the present invention utilizes backlight illumination to identify an alert status. During a normal, non-alert condition, a first backlight illumination color is used. A second backlight color illumination is used to identify an intermediate alert status, and the second backlight color illumination flashed on/off to identify an high alert status.

The different backlight illumination colors arc realized through the use of conventional light emitting diodes LED's 34. One of ordinary skill in the art will appreciate that multi-color backlight illumination can be achieved using two or more separate LED's 34, each LED radiating a different color. Alternatively, the same result can be achieved using well known two color LED's. According to the preferred embodiment (shown in FIG. 1), four red LED's 34R and four green LED's 34G (shown hidden) are positioned below the LCD 32.

Moreover, one of ordinary skill in the art will appreciate the fact that the present invention is not limited to two colors, as additional colors may be used simply by adding additional different colored LED's.

Table II lists the ranking of various alert states according to a preferred embodiment, including the error message displayed, and the backlight illumination.

TABLE II

| State | Ranking | Message | Illumination |
|---|---|---|---|
| Normal | 0 | None | Green Light |
| Low Battery | 1 | batt | Red |
| Decompression Mode | 2 | DECO xx | Red |
| Fast Ascent | 3 | SLOW ▼ | Flashing Red |

Figure 3A:
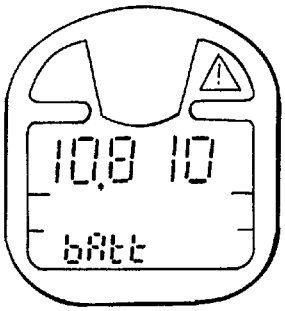
FIG. 3A shows the present dive computer indicating a low battery warning.
Figure 3B:
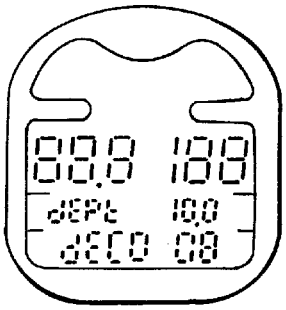
FIG. 3B shows the present dive computer indicating a decompression warning.

For example, a low charge condition of a battery will trigger a low battery state which has a ranking of 1 and will cause the illumination to change from a normal (green) to intermediate alert illumination (red), and will further cause a message "batt" to be displayed on the screen. See, e.g. FIG. 3A. However, if a higher ranking alert subsequently occurs, such as triggered by entry into decompression mode, the message "DECO xx" will be displayed. See, e.g. FIG. 3B. In operation, the message "xx" will reflect the amount of decompression time required.

Figure 3C:
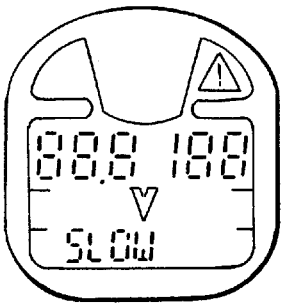
FIGS. 3C shows the present dive computer indicating a rapid ascent warning.

Subsequently, if an even higher alert condition is triggered, i.e. excessive rate of ascent, the message "SLOW ▼" will be displayed, and the backlight illumination will be flashing red. See, e.g. FIG. 3C.

One of ordinary skill in the art will appreciate the use of hierarchical messages in combination with the changes in backlight illumination color enable a diver to quickly determine the dive status. Notably, the change in backlight illumination color (from green to red in the preferred embodiment) signals to a diver that an intermediate alert condition exists, whereas a flashing red backlight signals that the immediate safety of the diver is in jeopardy. According to the hierarchy of Table II, a flashing red backlight signals that the diver is ascending too quickly. Notably, a singular alert condition is identified by the flashing red backlight signal. Thus, a diver seeing the flashing red backlight will know how to respond without reading the accompanying warning message.

In contrast, conventional dive computers rely on flashing icons or case mounted LED's which are difficult for a diver to quickly and easily interpret.

Figure 4:
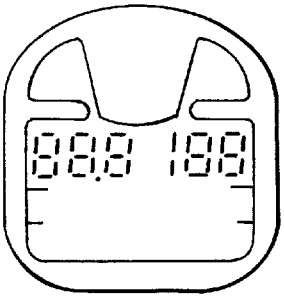
FIG. 4 shows a minimalistic display according to the present invention.

According to another aspect of the invention, the display screen 32 includes at least one user customizable display area in which the user may choose to have additional dive related parameters. The user can elect to have a minimalist display such as shown in FIG. 4. The minimalist display selects the dive critical data which every diver must track. Notably, this critical data includes no-stop time 40, current depth 42 and dive time 44. Preferably, the no-stop time is displayed graphically using bar-like segments, where each segment represents a predetermined amount of time.

The minimalistic display further includes a warning message area 46 (See, FIGS. 3A and 3C) in which the above-described hierarchical warning messages are displayed.

Figure 5A:
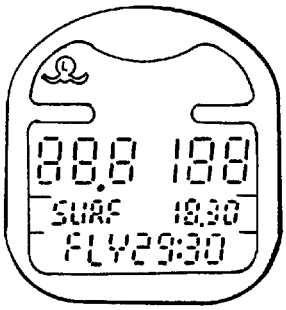
FIGS. 5A and 5B show customizable display fields according to the present invention.
Figure 5B:
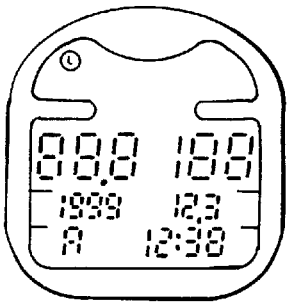

The user can elect to have additional information displayed on the customizable display area by toggling through the command tree using the input interface 12. Notably, the user can elect to have a single item of additional information such as max depth, surface time, water temperature or the like displayed. See, e.g. FIGS. 3B, 5A and 5B. Alternatively, the user can elect to have several items of data scrolled periodically on the customizable display area. In this manner, the dive computer of the present invention can be configured to meet the demands of both novice and expert diver alike.

Regardless of the display mode selected, the display will always include a warning message area 46. Thus, the present alert condition can readily be determined.

According to another aspect of the present invention, the dive computer includes a software activated memory clearing feature (software switch). This feature is especially important in a rental situation or the like in which the dive computer is used by various divers. The software switch of the present invention enables diver specified information to be cleared from memory quickly and easily. Importantly, the software switch does not rely on a mechanical switch such as utilized by conventional dive apparatus.

It should be appreciated that the use of a software switch according to the present invention avoids the corrosion and impact related problems associated with mechanical switches and the like.

In operation, the software switch is selected by entering unique sequence of commands into the input interface 12. Importantly, as described above, the input interface 12 incorporates a lock-out mechanism which prevents entry of commands via the input interface 12 when the contacts 12*a*, 12*b* and 12*c* are wet. Thus, the accidental actuation of the software switch during a dive is assured.

While various embodiments of the present interactive dive computer have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. An interactive apparatus for use by a scuba diver to determine a maximum dive duration, said apparatus comprising:

input means for setting dive specific parameters including a J-factor parameter for adjusting a no-stop time calculation to compensate for various environmental and physiological parameters;

clock means for determining an elapsed dive time duration;

depth sensor means for detecting a present depth and a maximum depth, said depth sensor means tracking a dwell time in each of plural predetermined depth ranges;

processor means communicating with said input means, said clock means and said depth sensor means, said processor means determining a remaining no-stop time in accordance with said J-factor and said detected dwell time, wherein said display means for displaying at least one of said maximum depth, said current depth, said elapsed dive time duration and said remaining no-decompression dive time.

2. An interactive apparatus according to claim 1, further comprising:

hierarchical warning means for alerting the scuba diver of an alert condition, whereby if multiple alert conditions exist only a highest priority warning is displayed.

3. An interactive apparatus according to claim 2, wherein:

said display means displays a first color to designate a normal non-alert condition, said display means displays a second color to designate an intermediate alert condition, and said display means displays flashes said second color to designate an advanced alert condition.

4. An interactive apparatus according to claim 3, wherein said processor means instructs said display means to display said second color when said no-decompression dive time has expired, and instructs said display means to display a decompression warning message in a warning field of said display.

5. An interactive apparatus according to claim 4, wherein:

said processor means includes an ascent detection function which determines a rate of ascent by monitoring said detected depth values over a predetermine time interval, said processor means comparing said rate of ascent with a predetermined maximum safe rate of ascent and instructs said display means to display and flash said second color when said rate of ascent exceeds said maximum safe rate of ascent, and instructs said display means to display an ascent warning message in a warning field of said display, said ascent warning message having a higher priority than said decompression warning message.

6. An interactive apparatus according to claim 5, further comprising:

battery monitoring means for alerting said processor when a low battery condition exists;

said processor means, in response to said low battery alert, instructing said display means to display said second color and display a battery warning message in a warning field of said display, said battery warning message having a lower priority than said decompression warning message.

7. An interactive apparatus according to claim 1, wherein:

said display means includes a predetermined number of customizable display fields in which the scuba diver selects the information to be displayed.

8. An interactive apparatus according to claim 1, further comprising:

software reset means for clearing said dive specific parameters without the use of mechanical switches; and a safety mechanism which assuredly prevents activation of said software reset means once a dive has commenced.

9. An interactive apparatus for use by a scuba diver to determine a maximum no-decompression dive duration, said apparatus comprising:

input means for setting dive specific parameters including a J-factor for adjusting a no-stop time calculation to compensate for various environmental and physiological parameters;

clock means for determining an elapsed dive time duration;

depth sensor means for detecting a present depth and a maximum depth, said depth sensor means tracking a dwell time in each of plural predetermined depth ranges;

processor means communicating with said input means, said clock means and said depth sensor means, said processor means determining a remaining no-stop time in accordance with said J-factor and said detected dwell time, LCD display means for displaying at least said elapsed dive time duration, said detected present depth and said no-stop time;

a multi-color backlight illumination means for illuminating at least a first color designating a normal non-alert condition, a second color designating an intermediate alert condition, and for flashing said second color to designate an advanced alert condition.

10. An interactive apparatus according to claim 9, wherein said multi-color backlight illumination means is one of at least one LED capable of illuminating at least two different colors, and at least two LED's a first LED being capable of illuminating a different color than a second LED.

11. An interactive apparatus according to claim 9, further comprising:

software reset means for clearing said dive specific parameters without the use of mechanical switches; and a safety mechanism which assuredly prevents activation of said software reset means once a dive has commenced.

* * * * *